US009909548B2

(12) United States Patent
Shimizu

(10) Patent No.: US 9,909,548 B2
(45) Date of Patent: Mar. 6, 2018

(54) FUEL INJECTOR

(71) Applicant: DENSO CORPORATION, Kariya, Aichi-pref. (JP)

(72) Inventor: Makoto Shimizu, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/145,521

(22) Filed: May 3, 2016

(65) Prior Publication Data

US 2016/0327002 A1 Nov. 10, 2016

(30) Foreign Application Priority Data

May 7, 2015 (JP) ..... 2015-094879

(51) Int. Cl.
*F02M 61/16* (2006.01)
*F02M 47/02* (2006.01)

(52) U.S. Cl.
CPC ..... *F02M 61/168* (2013.01); *F02M 47/027* (2013.01); *F02M 2200/8015* (2013.01); *F02M 2200/852* (2013.01)

(58) Field of Classification Search
CPC ..... F02M 61/168; F02M 47/027; F02M 2200/852; F02M 2200/8015
USPC ..... 239/584, 533.3, 590.5, 533.11, 96
See application file for complete search history.

(56) References Cited

U.S. PATENT DOCUMENTS 6,557,776 B2 * 5/2003 Carroll, III ..... F02M 45/086 239/124
6,719,221 B2 * 4/2004 Klugl ..... F02M 55/002 239/127
6,749,127 B2 * 6/2004 Lorraine ..... F02M 51/0603 239/5
7,162,355 B2 * 1/2007 Yoda ..... F02M 47/027 29/890.12
8,695,899 B2 * 4/2014 Maragliulo ..... F02M 51/061 239/5

(Continued)

FOREIGN PATENT DOCUMENTS

DE 102014221860 A1 * 4/2016 ..... F02M 61/168
JP H11-294301 10/1999
JP 2005-299641 10/2005

*Primary Examiner* — Arthur O Hall
*Assistant Examiner* — Joseph A Greenlund
(74) *Attorney, Agent, or Firm* — Nixon & Vanderhye PC

(57) ABSTRACT

A fuel injector includes an injection-port forming member, a passage forming member, and a positioning member. The passage forming member is in contact with the injection-port forming member. The positioning member that is a partially ring shape spans and is externally fitted to the injection-port forming member and the passage forming member, and executes a positioning between the injection-port forming member and the passage forming member. The injection-port forming member and the passage forming member include continuous flat surfaces that can be connected with each other, respectively. The positioning member includes an opposite flat surface that faces both the continuous flat surfaces in a case where the positioning member is externally fitted to the injection-port forming member and the passage forming member, and a pressing portion that inwardly presses the outer peripheral wall portions such that the continuous flat surfaces are in contact with the opposite flat surface.

9 Claims, 5 Drawing Sheets

(56) References Cited

U.S. PATENT DOCUMENTS

| | | | | |
|---|---|---|---|---|
| 8,833,735 | B2 * | 9/2014 | Uhlmann | F02M 61/168 239/533.2 |
| 9,109,556 | B2 * | 8/2015 | Adachi | F02M 47/027 |
| 9,228,553 | B2 * | 1/2016 | Kosiorek | F02M 57/025 |
| 2006/0202049 | A1 * | 9/2006 | Miller | B05B 1/302 239/5 |
| 2012/0152206 | A1 * | 6/2012 | Adachi | F02M 47/027 123/445 |
| 2014/0007845 | A1 * | 1/2014 | Atzkern | F02M 61/168 123/447 |
| 2016/0327002 | A1 * | 11/2016 | Shimizu | F02M 47/027 |

* cited by examiner

FUEL INJECTOR

CROSS REFERENCE TO RELATED APPLICATION

This application is based on Japanese Patent Application No. 2015-94879 filed on May 7, 2015, the disclosure of which is incorporated herein by reference.

TECHNICAL FIELD

The present disclosure relates to a fuel injector which injects a fuel from an injection port towards a combustion chamber of an internal combustion engine.

BACKGROUND

Conventionally, as descriptions in JP2005-299641A, a fuel injector includes a nozzle body defining an injection port, and a nozzle holder defining a passage of a fuel supplied to the injection port. In the above fuel injector, it is necessary that a position of the nozzle body relative to the nozzle holder is limited in a peripheral direction.

Therefore, in the fuel injector according to JP2005-299641A, a positioning plate that is a partially ring shape is provided. The positioning plate includes two engagement portions that inwardly protrude. The positioning plate spans and is externally fitted to the nozzle body and the nozzle holder, and the engagement portions are engaged with positioning grooves arranged at the nozzle body and the nozzle holder, respectively. The position of the nozzle body relative to the nozzle holder in the peripheral direction is limited by the positioning plate.

SUMMARY

According to the above configuration in JP2005-299641A, it is unavoidable that a dimension difference of each of the engagement portions of the positioning plate and a dimension difference of each of the positioning grooves of the nozzle body and the nozzle holder exist. Therefore, when each of the engagement portions is engaged with each of the positioning grooves of the nozzle body, gaps are generated therebetween. Thus, the positioning plate is assembled with the nozzle body in a state where a backlash exists between the positioning plate and the nozzle body. Similarly, when each of the engagement portions is engaged with each of the positioning grooves of the nozzle holder, gaps are generated therebetween. Thus, the positioning plate is assembled with the nozzle holder in a state where a backlash exists between the positioning plate and the nozzle holder. As the above description, backlashes are generated between the positioning plate and the nozzle body and between the positioning plate and the nozzle holder. As a result, it is difficult to sufficiently ensure an accuracy of a positioning between the nozzle body and the nozzle holder.

It is an object of the present disclosure to provide a fuel injector which can ensure an accuracy of a positioning between an injection-port forming member such as a nozzle body and a passage forming member such as a nozzle holder.

According to an aspect of the present disclosure, a fuel injector includes an injection-port forming member, a passage forming member, and a positioning member. The injection-port forming member includes an injection port that injects a fuel towards a combustion chamber of an internal combustion engine. The passage forming member is in contact with the injection-port forming member and includes a supply passage that supplies the fuel to the injection port. The positioning member that is a partially ring shape spans and is externally fitted to the injection-port forming member and the passage forming member, and executes a positioning between the injection-port forming member and the passage forming member. The injection-port forming member and the passage forming member include continuous flat surfaces that can be connected with each other, respectively, and the continuous flat surfaces are arranged at outer peripheral wall portions to which the positioning member is externally fitted. The positioning member includes an opposite flat surface that faces both the continuous flat surfaces in a case where the positioning member is externally fitted to the injection-port forming member and the passage forming member, and a pressing portion that inwardly presses the outer peripheral wall portions such that the continuous flat surfaces are in contact with the opposite flat surface.

According to the present disclosure, when the continuous flat surfaces arranged at the injection-port forming member and the passage forming member, respectively, are connected with each other, the positioning member is externally fitted with the injection-port forming member and the passage forming member. Then, at least one of the injection-port forming member or the passage forming member is pressed towards the outer peripheral wall portion by the pressing portion of the positioning member, such that the continuous flat surface is in contact with the opposite flat surface. Since the opposite flat surface and the pressing portions pinch the injection-port forming member and the passage forming member, the positioning member can be assembled with the injection-port forming member and the passage forming member in a state where a backlash does not exist between the positioning member and at least one of the injection-port forming member or the passage forming member. Therefore, an accuracy of a positioning between the injection-port forming member and the passage forming member can be improved.

BRIEF DESCRIPTION OF THE DRAWINGS

The above and other objects, features and advantages of the present disclosure will become more apparent from the following detailed description made with reference to the accompanying drawings. In the drawings.

DESCRIPTION OF EMBODIMENTS

Figure 1:
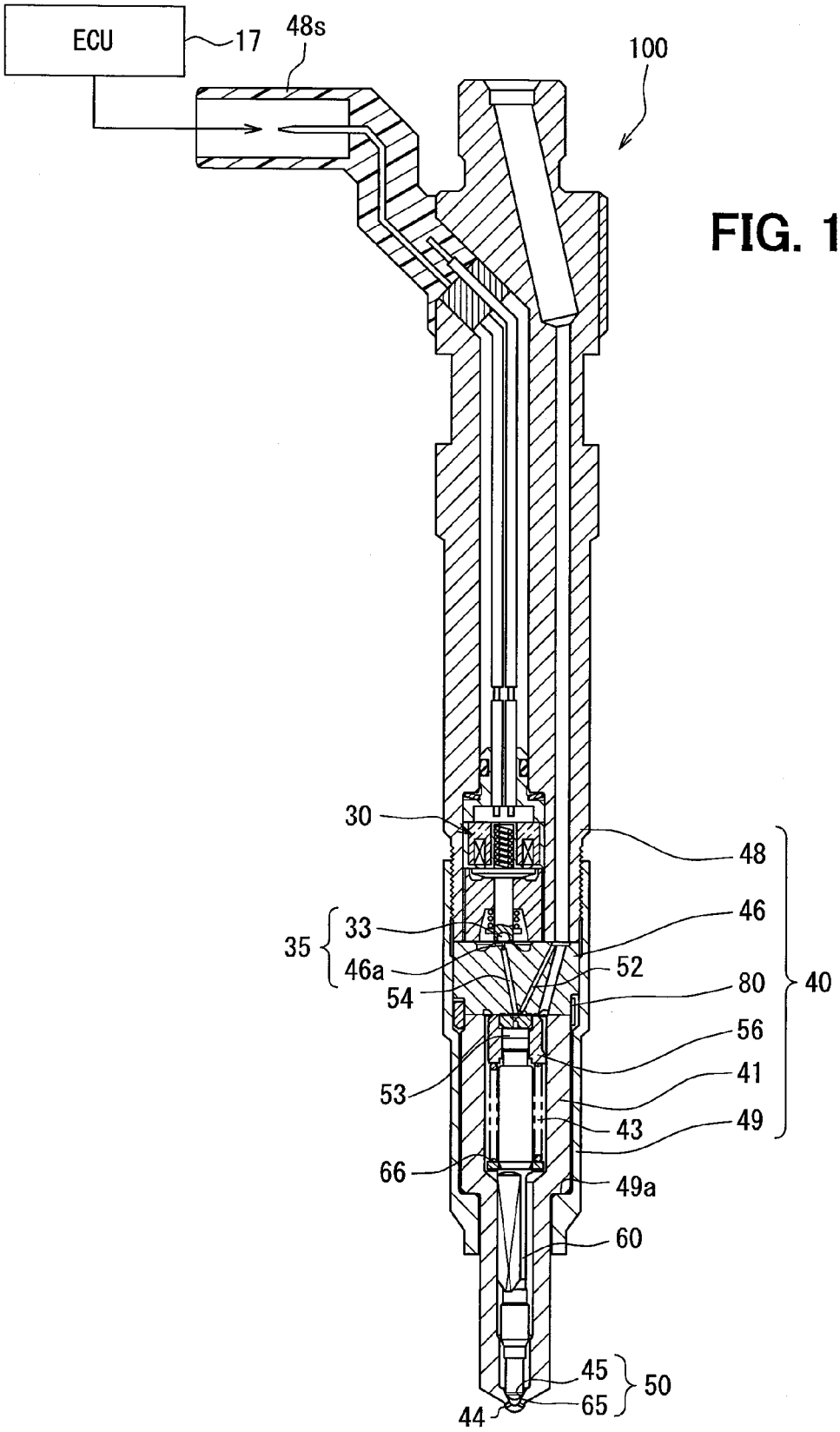
FIG. 1 is a longitudinal-section view showing a fuel injector according to an embodiment of the present disclosure.

Embodiments of the present disclosure will be described hereafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

As shown in FIG. 1, a fuel injector 100 according to an embodiment of the present disclosure is inserted into an insertion hole of a head member defining a combustion chamber of a diesel engine and is assembled with the head member. The fuel injector 100 directly injects a high-pressure fuel supplied through a fuel pipe from an injection port 44 towards the combustion chamber. The fuel injector 100 includes a driving portion 30, a control body 40, and a nozzle needle 60.

The driving portion 30 is received in the control body 40. The driving portion 30 is mounted with a control-valve face member 33. The control-valve face member 33 and a control seat portion 46*a* constitute a pressure control valve 35. A control signal that is a pulse form is transmitted from an engine control unit 17 to the driving portion 30. The driving portion 30 opens and closes the pressure control valve 35 by displacing the control-valve face member 33 based on the control signal. When a power supply is stopped from the engine control unit 17, the driving portion 30 controls the control-valve face member 33 to be seated on the control seat portion 46*a*. Therefore, the pressure control valve 35 is in a valve closing state. When the power supply is activated from the engine control unit 17, the driving portion 30 controls the control-valve face member 33 to be separated from the control seat portion 46*a*. Therefore, the pressure control valve 35 is in a valve opening state.

The control body 40 is provided with the injection port 44, an inlet passage 52, an outlet passage 54, a supply passage 55, and a pressure control chamber 53. The injection port 44 is arranged at a distal portion of the control body 40 in an insertion direction that the control body 40 is inserted into the combustion chamber. The distal portion is a conical shape or a hemispherical shape. Plural injection ports 44 are arranged radially from an interior of the control body 40 towards an exterior of the control body 40. The high-pressure fuel is injected to the combustion chamber through the injection ports 44. Since the high-pressure fuel is injected through each of the injection ports 44, the high-pressure fuel is atomized and is sprayed so as to be easily mixed with an air.

The high-pressure fuel supplied to the fuel injector 100 through the fuel pipe flows into the pressure control chamber 53 through the inlet passage 52. When the pressure control valve 35 is opened, the high-pressure fuel that is a fuel in the pressure control chamber 53 flows into the fuel pipe through the outlet passage 54. In the control body 40, the supply passage 55 branches from the inlet passage 52. The supply passage 55 is a cylindrical shape and spans plural member constituting the control body 40. The high-pressure fuel supplied to the fuel injector 100 is introduced to the injection port 44 through the supply passage 55.

The pressure control chamber 53 is placed at a position in the control body 40 opposite to the injection port 44 relative to the nozzle needle 60. In other words, the nozzle needle 60 is interposed between the pressure control chamber 53 and the injection port 44. The pressure control chamber 53 changes a pressure of the high-pressure fuel according to an entering of the high-pressure fuel that flows in from the inlet passage 52 or a discharge of the high-pressure fuel that flows out through the outlet passage 54. The pressure control chamber 53 controls a movement of the nozzle needle 60 by using the pressure of the high-pressure fuel.

The control body 40 is constituted by a nozzle body 41, a cylinder 56, an orifice plate 46, a holder 48, a retaining nut 49, and a guide ring 80. The nozzle body 41, the orifice plate 46, and the holder 48 are arranged in this order from the distal portion that is inserted into the heat member in the insertion direction.

The nozzle body 41 is made of a metal material such as a chromium or a molybdenum steel, and is a bottomed cylindrical shape. The nozzle body 41 defines the injection port 44 and a part of the supply passage 55. The nozzle body 41 is provided with a nozzle-needle receiving chamber 43 and a seat portion 45. The nozzle-needle receiving chamber 43 receives the nozzle needle 60. The seat portion 45 that is a conical shape is defined by an inner peripheral surface of the nozzle body 41, and is in contact with a distal end of the nozzle needle 60.

The cylinder 56 is made of a metal material and is a cylindrical shape. The cylinder 56, the orifice plate 46, and the nozzle needle 60 define the pressure control chamber 53. The cylinder 56 limits a displacing direction of the nozzle needle 60 by controlling the nozzle needle 60 to slide in an axial direction of the cylinder 56.

The orifice plate 46 is made of a metal material such as a chromium or a molybdenum steel, and is a disc shape. The orifice plate 46 and the nozzle body 41 are arranged at positions along the axial direction, and the orifice plate 46 is in contact with the nozzle body 41. The orifice plate 46 defines the inlet passage 52, the outlet passage 54, and a part of the supply passage 55. The orifice plate 46 includes the control seat portion 46*a*. The control seat portion 46*a* and the control-valve face member 33 define the pressure control valve 35. The pressure control valve 35 switches to allow and to interrupt a communication between the outlet passage 54 and the fuel pipe.

The holder 48 is made of a metal material such as a chromium or a molybdenum steel, and is a tubular shape. The holder 48 includes a socket portion 48*s*. A plug portion connected with the engine control unit 17 is fitted to the socket portion 48*s*. The control signal is supplied from the engine control unit 17 to the driving portion 30 through the plug portion that is connected with the socket portion 48*s*.

The retaining nut 49 is made of a metal material and is a two-level cylindrical shape. The retaining nut 49 receives a part of the nozzle body 41, the guide ring 80, and the orifice plate 46, and is threaded with the holder 48. Since the retaining nut 49 is assembled with the holder 48, the retaining nut 49 presses the nozzle body 41 and the orifice plate 46 towards the holder 48 by a step portion 49*a*. The retaining nut 49 holds the nozzle body 41, the orifice plate 46, and the holder 48.

The nozzle needle 60 is made of a metal material such as a high-speed tool steel and is a columnar shape. The nozzle needle 60 slides in the nozzle body 41 in an axial direction of the nozzle body 41. The nozzle needle 60 is biased towards the seat portion 45 by a return spring 66 to which a wiring that is made of a metal is spirally wound. The nozzle needle 60 includes a face portion 65. The face portion 65 is a conical shape that an outer diameter of the face portion 65 decreases toward a distal end of the face portion 65. The face portion 65 and the seat portion 45 constitute a main valve portion 50 that opens and closes the injection port 44. The face portion 65 of the nozzle needle 60 is seated on or separated from the seat portion 45 according to a variation of a pressure of the fuel in the pressure control chamber 53.

In the fuel injector 100, since the injection ports 44 are not arranged in the same intervals in a peripheral direction of the nozzle body 41, the nozzle body 41 and the orifice plate 46 are fixed to the retaining nut 49 after being positioned relative to each other. A positioning of the nozzle body 41 and the orifice plate 46 is executed by the guide ring 80. Hereafter, a configuration of the nozzle body 41, the orifice plate 46, and the guide ring 80 used to execute the positioning will be described.

Figure 2:
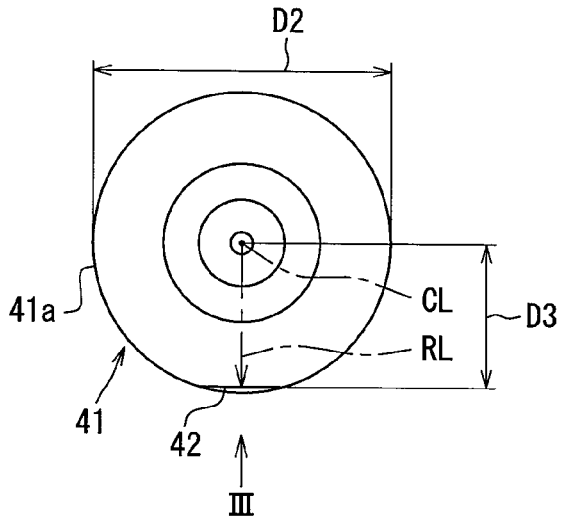
FIG. 2 is a plan view showing a nozzle body viewed along an arrow II in FIG. 3.
Figure 3:
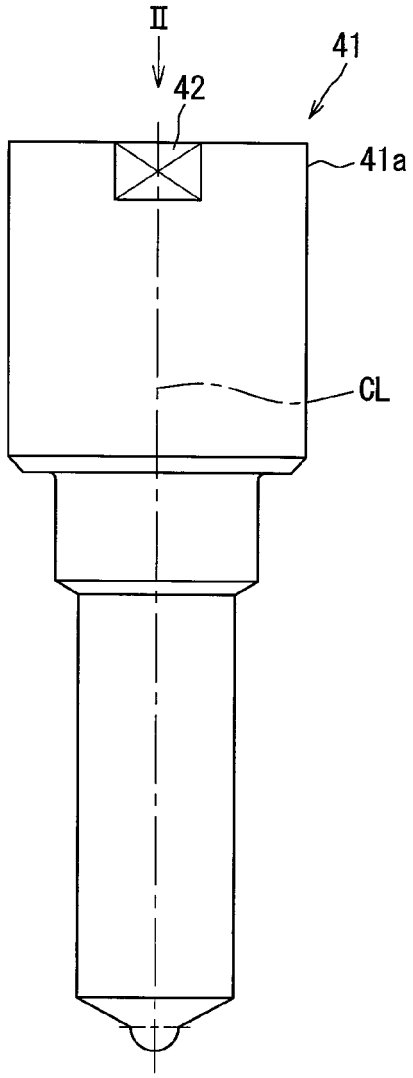
FIG. 3 is a front view showing the nozzle body viewed along an arrow III in FIG. 2.
Figure 6:
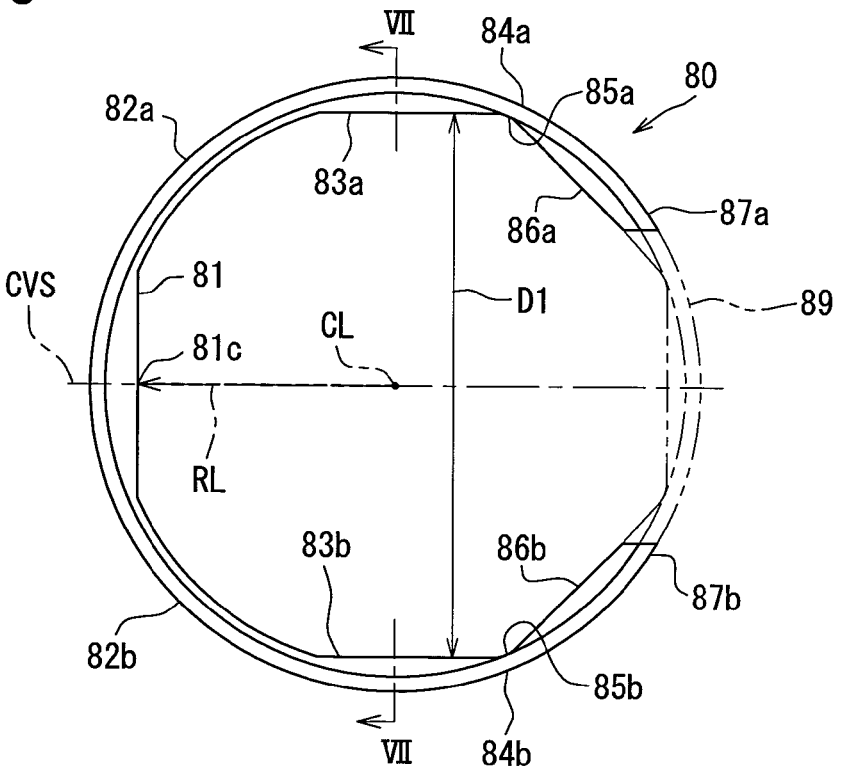
FIG. 6 is a bottom view showing a guide ring viewed along an arrow VI in FIG. 7.

As shown in FIGS. 2 and 3, the nozzle body 41 includes an outer peripheral wall portion 41*a*. The outer peripheral wall portion 41*a* is placed at an edge portion of a base end of the nozzle body 41. The based end of the nozzle body 41 is in contact with the orifice plate 46 shown in FIG. 4. As shown in FIG. 6, the guide ring 80 is externally fitted to the outer peripheral wall portion 41*a*. The outer peripheral wall portion 41*a* includes a nozzle flat surface 42.

The nozzle flat surface 42 is a flat surface substantially perpendicular to a reference line RL that is a virtual line extends from a center axis line CL of the nozzle body 41 in a radial direction of the nozzle body 41. The nozzle flat surface 42 is formed by partially removing the outer peripheral wall portion 41*a* that is a cylindrical-shaped surface by a cutting processing. An area of the outer peripheral wall portion 41*a* excluding the nozzle flat surface 42 is a partially cylindrical-shaped surface. The nozzle flat surface 42 is placed at a position that is separated from the center axis line CL by a distance D3. In this case, the distance D3 is slightly shorter than a radius dimension that is a half of an outer diameter dimension D2 of the outer peripheral wall portion 41*a*. The nozzle flat surface 42 is a plane surface that is a rectangle. Further, a dimension of the rectangle in a horizontal direction is longer than a dimension of the rectangle in a vertical direction that is parallel to the axial direction of the nozzle body 41.

Figure 4:
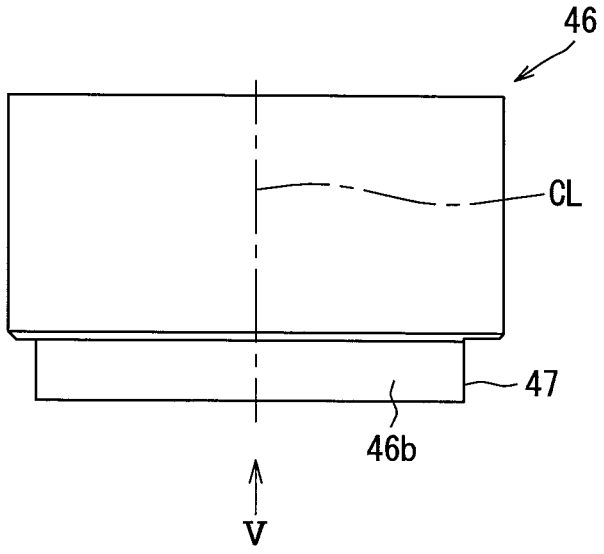
FIG. 4 is a front view showing an orifice plate viewed along an arrow IV in FIG. 5.
Figure 5:
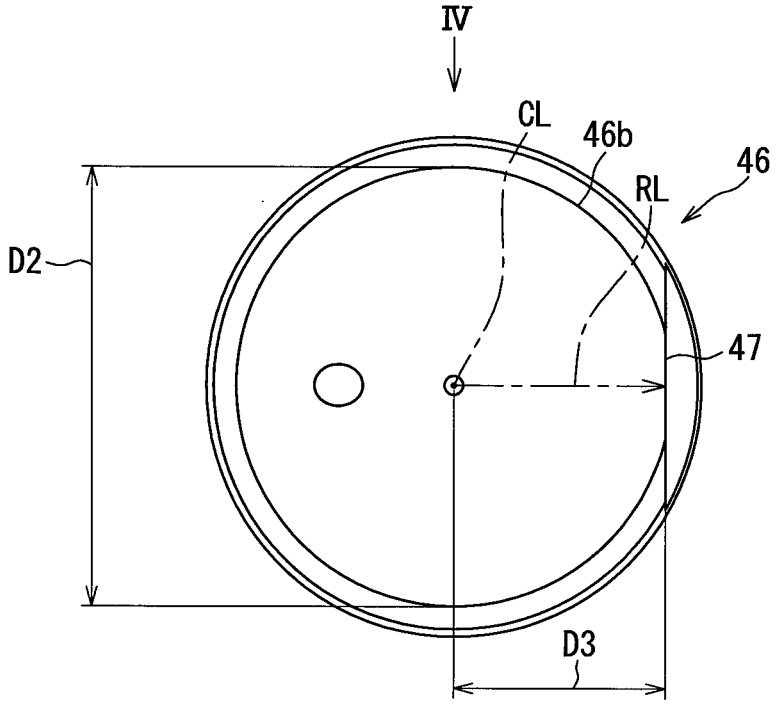
FIG. 5 is a front view showing the orifice plate viewed along an arrow V in FIG. 4.

As shown in FIGS. 4 and 5, the orifice plate 46 includes an outer peripheral wall portion 46*b*. The outer peripheral wall portion 46*b* is placed at an edge portion of a distal end of the orifice plate 46. The distal end of the orifice plate 46 is in contact with the nozzle body 41 shown in FIG. 2. As shown in FIG. 6, the guide ring 80 is externally fitted to the outer peripheral wall portion 46*b*. The outer peripheral wall portion 46*b* is a cylindrical-shaped surface. An outer diameter dimension of the outer peripheral wall portion 46*b* and a tolerance range of the outer diameter dimension are set such that the outer diameter dimension of the outer peripheral wall portion 46*b* is substantially as the same as that of the outer peripheral wall portion 41*a* which is D2 shown in FIG. 2. The outer peripheral wall portion 46*b* includes an orifice flat surface 47.

The orifice flat surface 47 is a flat surface substantially perpendicular to the reference line RL that is a virtual line extends from the center axis line CL of the orifice plate 46 in the radial direction of the orifice plate 46. The orifice flat surface 47 is formed by partially removing the outer peripheral wall portion 46*b* that is a cylindrical-shaped surface by a cutting processing. An area of the outer peripheral wall portion 46*b* excluding the orifice flat surface 47 is a partially cylindrical-shaped surface. A distance between the center axis line CL and the orifice flat surface 47 in the radial direction and a tolerance range of the distance are set such that the distance is substantially as the same as the distance D3 between the center axis line CL and the nozzle flat surface 42 in the radial direction shown in FIG. 2. The orifice flat surface 47 is a plane surface that is a rectangle. Further, a dimension of the rectangle in a horizontal direction is longer than a dimension of the rectangle in a vertical direction that is parallel to an axial direction of the orifice plate 46. The dimension of the orifice flat surface 47 in the vertical direction is shorter than the dimension of the nozzle flat surface 42 in the vertical direction. The dimension of the orifice flat surface 47 in the horizontal direction is substantially as the same as the dimension of the nozzle flat surface 42 in the horizontal direction.

Figure 7:
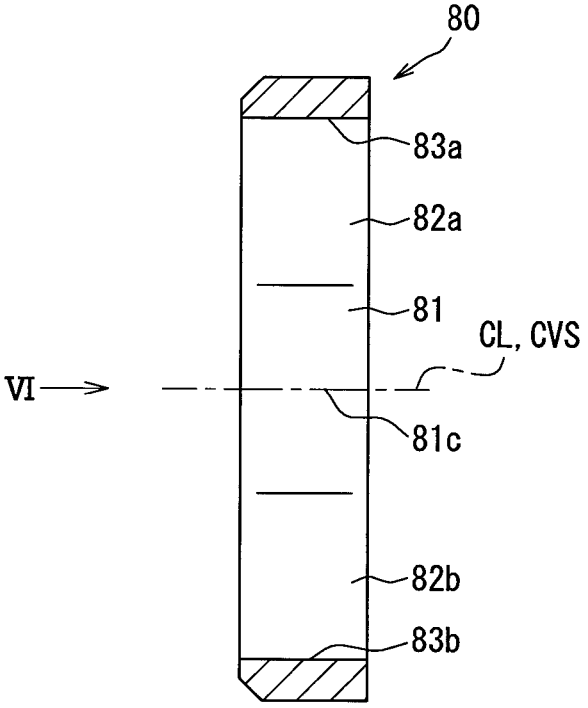
FIG. 7 is a cross-section view showing the guide ring viewed along a line VII-VII in FIG. 6.

As shown in FIGS. 6 and 7, the guide ring 80 is made of a metal material and is a partially ring shape. The guide ring 80 is a one-piece member. The guide ring 80 is a ring-shaped member which is partially removed. A height of the guide ring 80 in an axial direction of the guide ring 80 is substantially constant over an entire periphery of the guide ring 80. The guide ring 80 is plane symmetry relative to a center vertical section CVS that is a virtual plane surface including the center axis line CL of the guide ring 80.

Figure 8:
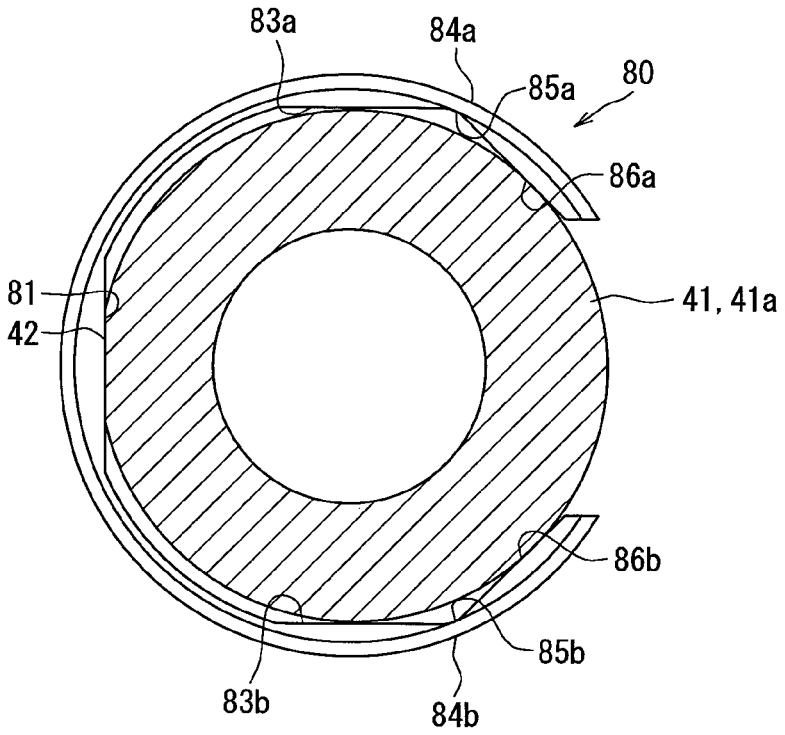
FIG. 8 is a cross-section view showing a part of the fuel injector viewed along a line VIII-VIII in FIG. 9.
Figure 9:
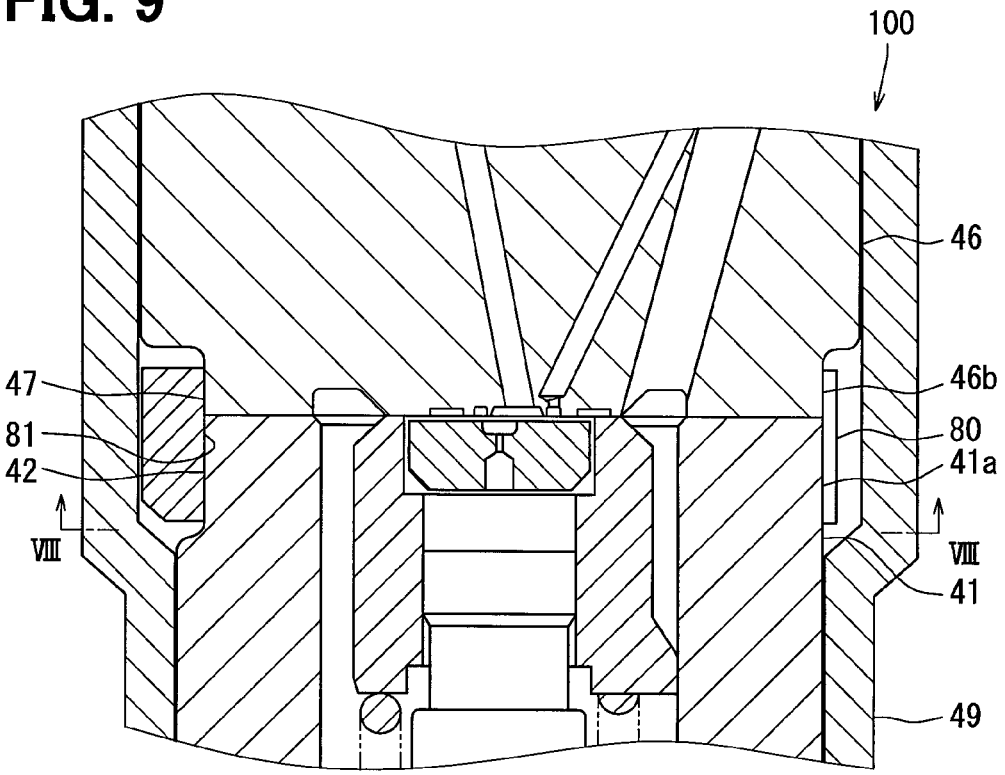
FIG. 9 is a longitudinal-section view showing a part of the fuel injector of when the guide ring is externally fitted to the nozzle body and the orifice plate.

A wall portion that is bent and constitutes the guide ring 80 is a strip shape, and a thickness of the wall portion in the radial direction is thinner than a thickness of the wall portion in the axial direction. Therefore, the guide ring 80 can bend in the radial direction. As shown in FIGS. 8 and 9, the guide ring 80 spans and is externally fitted to the nozzle body 41 and the orifice plate 46, and pinches the outer peripheral wall portions 41*a*, 46*b*. Therefore, the guide ring 80 can execute a positioning of the nozzle body 41 and the orifice plate 46 relative to each other. As shown in FIGS. 6 and 7, to achieve a positioning function, the guide ring 80 includes a first flat surface 81, first extension walls 82*a* and 82*b*, second flat surfaces 83*a* and 83*b*, second extension walls 84*a* and 84*b*, and pressing portions 86*a* and 86*b*.

In the guide ring 80 that is a partially ring shape, the first flat surface 81 is placed at an intermediate position in a peripheral direction of the guide ring 80. Further, the first flat surface 81 is placed at a position opposite to a notch area 89 relative to the center axis line CL in a radial direction of the guide ring 80. The first flat surface 81 is a plane surface that is substantially perpendicular to the reference line RL that is a virtual line extends from the center axis line CL of the guide ring 80 in the radial direction of the guide ring 80. The first flat surface 81 is perpendicular to the center vertical section CVS and is parallel to the center axis line CL. The first flat surface 81 is substantially rectangle shape.

Since the guide ring 80 is externally fitted to the nozzle body 41 and the orifice plate 46, the first flat surface 81 faces the nozzle flat surface 42 and the orifice flat surface 47 as shown in FIGS. 8 and 9. A dimension of the first flat surface 81 in the vertical direction is longer than both the dimension of the nozzle flat surface 42 in the vertical direction and the dimension of the orifice flat surface 47 in the vertical direction, and is shorter than a sum of the dimension of the nozzle flat surface 42 in the vertical direction and the dimension of the orifice flat surface 47. A dimension of the first flat surface 81 in the horizontal direction is longer than both the dimension of the nozzle flat surface 42 in the horizontal direction and the dimension of the orifice flat surface 47 in the horizontal direction.

The first extension walls 82*a* and 82*b* extend from the first flat surface 81 to the second flat surfaces 83*a* and 83*b*, respectively, to be arc shapes. The first extension walls 82*a* and 82*b* have thicknesses in the radial direction which are constant, and are interposed between the first flat surface 81 and the second flat surfaces 83*a* and 83*b*, respectively. In other words, the first extension walls 82*a* and 82*b* connect the first flat surface 81 to the second flat surfaces 83*a* and 83*b*, respectively. The first extension walls 82*a* and 82*b* have inner peripheral wall surfaces which are cylindrical-shaped surfaces. In this case, the center axis line CL is a center of the cylindrical-shaped surfaces. Each of the inner peripheral wall surfaces of the first extension walls 82*a* and 82*b* has a radius of curvature is substantially constant and is set to be larger than a radius of each of the outer peripheral wall portions 41*a* and 46*b* shown in FIGS. 2 and 5.

The second flat surfaces 83*a* and 83*b* have centers which are shifted from a center 81*c* of the first flat surface 81 by 90 degrees in the peripheral direction, respectively. The second flat surfaces 83*a* and 83*b* are parallel to the center vertical section CVS. The second flat surfaces 83*a* and 83*b* are placed at positions between the first flat surface 81 and the pressing portions 86*a* and 86*b* in the peripheral direction, respectively. The second flat surfaces 83*a* and 83*b* face to each other in the radial direction of the guide ring 80 by interposing the center axis line CL. A separating dimension D1 that is a distance between the second flat surfaces 83*a* and 83*b* is set to be substantially as the same as the outer diameter dimensions D2 of the outer peripheral wall portions 41*a* and 46*b*. Further, a tolerance range of the separating dimension D1 is set such that a minimum value of the separating dimension D1 is larger than or equal to a maximum value of the outer diameter dimension D2.

The second extension walls 84*a* and 84*b* extend from the second flat surfaces 83*a* and 83*b* to the pressing portions 86*a* and 86*b*, respectively, to be arc shapes. The second extension walls 84*a* and 84*b* include thin wall portions 85*a* and 85*b*, respectively. The thin wall portions 85*a* and 85*b* have thicknesses in the radial direction which are thinner than the thicknesses of the first extension walls 82*a* and 82*b*. Since the thin wall portions 85*a* and 85*b* are provided, rigidities of the second extension walls 84*a* and 84*b* in the radial direction are reduced to be less than rigidities of the first extension walls 82*a* and 82*b*. Areas from the thin wall portions 85*a* and 85*b* to end portions 87*a* and 87*b* are easily bent in the second extension walls 84*a* and 84*b* in the radial direction, respectively.

Two pressing portions 86*a* and 86*b* are arranged in the areas interposing the first flat surface 81 in the peripheral direction of the guide ring 80. The pressing portions 86*a* and 86*b* have centers which are shifted from the center 81*c* of the first flat surface 81 by an angle that is larger than 90 degrees in the peripheral direction, respectively. Therefore, the pressing portions 86*a* and 86*b* are placed at positions closer to the end portions 87*a* and 87*b* than the first flat surface 81 is, and the pressing portions 86*a* and 86*b* are placed at positions to interpose the notch area 89 in the peripheral direction. The pressing portions 86*a* and 86*b* are placed at positions to be plane symmetry relative to the center vertical section CVS. The pressing portions 86*a* and 86*b* is constituted by inner peripheral wall surfaces of the guide ring 80 which are plane shapes from the thin wall portions 85*a* and 85*b* to the end portions 87*a* and 87*b*, respectively. The inner peripheral wall surfaces are parallel to the axial direction of the guide ring 80 and a tangent direction of the outer peripheral wall portion 41*a* or 46*b*. The pressing portions 86*a* and 86*b* can displace in the radial direction by an elasticity of a material of when the guide ring 80 is made.

As the above configuration, as shown in FIGS. 8 and 9, since the nozzle body 41 rotates relative to the orifice plate 46 in the peripheral direction, the orifice flat surface 47 can be connected with the nozzle flat surface 42 in the axial direction that is a vertical direction. In this case, the nozzle flat surface 42 and the orifice flat surface 47 can constitute a continuous flat surface that is recessed from the outer peripheral wall portions 41*a* and 46*b*.

The nozzle body 41 and the orifice plate 46 are inserted into the guide ring 80 from two sides of the axial direction of the guide ring 80, respectively. Therefore, the guide ring 80 is externally fitted to the outer peripheral wall portions 41*a* and 46*b* of the nozzle body 41 and the orifice plate 46. As a result, both the nozzle flat surface 42 and the orifice flat surface 47 are in contact with each other at positions facing the first flat surface 81. Further, the pressing portions 86*a* and 86*b* are pressed towards an exterior of the entire periphery of the guide ring 80 by the outer peripheral wall portions 41*a* and 46*b*, and the pressing portions 86*a* and 86*b* are bent outwardly in the radial direction from start points that are the thin wall portions 85*a* and 85*b*. The pressing portions 86*a* and 86*b* are in line contact with the outer peripheral wall portions 41*a* and 46*b*, and generally inwardly press the outer peripheral wall portions 41*a* and 46*b* by reaction forces generated by elasticity of the second extension walls 84*a* and 84*b*. Therefore, the nozzle flat surface 42 and the orifice flat surface 47 are pressed towards the first flat surface 81, and can be in contact with the first flat surface 81. Thus, positions of the nozzle body 41 and the orifice plate 46 can be matched with each other in the peripheral direction. Since the retaining nut 49 is fastened to the holder 48 as shown in FIG. 1, the nozzle body 41 is assembled at a correct position relative to the orifice plate 46.

Even when the outer peripheral wall portions 41*a* and 46*b* have substantially the same outer diameter dimension D2 shown in FIGS. 2 and 5, it is likely that the outer diameter dimensions D2 vary in a tolerance range. Therefore, since the first flat surface 81 is in contact with a flat surface of one of the nozzle body 41 and the orifice plate 46 which has an outer diameter larger than that of the other one, the guide ring 80 is fixed to the one of the nozzle body 41 and the orifice plate 46. In this case, the outer diameter corresponds to an outer diameter of one of the outer peripheral wall portions 41*a* and 46*b*. According to the present embodiment, the one of the nozzle body 41 and the orifice plate 46 is referred to as a first member, and the other of the nozzle body 41 and the orifice plate 46 is referred to as a second member.

The second member which has the outer diameter smaller than that of the first member can move in an area defined by the guide ring 80. However, since a flat surface of the second member may be in contact with the first flat surface 81, a movement of the second member in the peripheral direction is limited. Further, the movement of the second member in the radial direction along the first flat surface 81 is limited by the second flat surfaces 83*a* and 83*b* which have the separating dimension D1 substantially as the same as the dimension between the outer peripheral wall portions 41*a* and 46*b*. Thus, a backlash generated between the second member and the guide ring 80 is extremely small.

According to the present embodiment, since the first flat surface 81 and the pressing portions 86*a* and 86*b* pinch the nozzle body 41 and the orifice plate 46, the guide ring 80 can be assembled with the nozzle body 41 and the orifice plate 46 in a state where a backlash does not exist between the guide ring 80 and at least one of the nozzle body 41 or the orifice plate 46. Therefore, an accuracy of a positioning between the nozzle body 41 and the orifice plate 46 can be improved. According to the present embodiment, the accuracy of the positioning is referred to as a positioning accuracy. Thus, in a manufacturing processing in a factory, it is easy that the nozzle body 41 is assembled with the orifice plate 46. Further, when the nozzle body 41 in which the injection port 44 is enlarged due to an abrasion after being used for a long period is exchanged in a market, an exchange work can be executed in a smaller man-hour without using a special equipment.

According to the present embodiment, only one nozzle flat surface 42 is arranged on the nozzle body 41, and only one orifice flat surface 47 is arranged on the orifice plate 46. When plural flat surfaces are arranged on the nozzle body 41 and the orifice plate 46, an unevenness inevitably occurs in a relative position of each of the flat surfaces. Therefore, since a variation of the relative position is generated, a deterioration in the positioning accuracy may occur. Thus, it is preferable that only one nozzle flat surface 42 is arranged on the outer peripheral wall portion 41*a* and only one orifice flat surface 47 is arranged on the outer peripheral wall portion 46*b*, so as to stably ensure a higher positioning accuracy.

According to the present embodiment, two pressing portions 86*a* and 86*b* are divided by the notch area 89. Therefore, the pressing portions 86*a* and 86*b* are independent from each other, and can independently execute a pressing operation to inwardly press the nozzle body 41 and the orifice plate 46. As the above description, at least one of the nozzle flat surface 42 or the orifice flat surface 47 can be surely in contact with the first flat surface 81. As a result, the guide ring 80 is surely assembled with the one of the nozzle body 41 and the orifice plate 46 in a state where a backlash does not exist between the guide ring 80 and the first member. Thus, the positioning accuracy is further improved.

According to the present embodiment, the pressing portions 86*a* and 86*b* are placed at positions that are shifted from the center 81*c* of the first flat surface 81 by an angle that is larger than 90 degrees in different directions of the peripheral direction. Therefore, pressing forces applied from the pressing portions 86*a* and 86*b* to the outer peripheral wall portions 41*a* and 46*b*, respectively, include vectors applied to the nozzle flat surface 42 and the orifice flat surface 47 in a direction towards the first flat surface 81. Since the guide ring 80 can be assembled in a state where a backlash does not exist between the guide ring 80 and the first member, the positioning accuracy is further improved.

According to the present embodiment, since the guide ring 80 is plane symmetry relative to the center vertical section CVS, the pressing portions 86*a* and 86*b* are also arranged to be plane symmetry relative to the center vertical section CVS. Therefore, in a state where the guide ring 80 is externally fitted to the outer peripheral wall portions 41*a* and 46*b*, the guide ring 80 is generally deformed to be plane symmetry relative to the center vertical section CVS. Thus, even when the guide ring 80 is deformed, two second flat surfaces 83*a* and 83*b* are placed at positions where distances between the second flat surfaces 83*a*, 83*b* and the center axis line CL are identical with each other. Thus, a movement of the second member in the radial direction is surely limited by the second flat surfaces 83*a* and 83*b*, and the second member can stay at a position in the vicinity of a formal position. In this case, the formal position is a position the second member that is requested.

According to the present embodiment, two second flat surfaces 83*a* and 83*b* placed at positions that are shifted from the first flat surface 81 by an angle that is equal to 90 degrees in the peripheral direction face each other by the separating dimension D1. Since a tolerance between the minimum value of the separating dimension D1 and the maximum value of the outer diameter dimension D2 is established, it is difficult that the second flat surfaces 83*a* and 83*b* are in contact with the outer peripheral wall portions 41*a* and 46*b*. Even when the second flat surfaces 83*a* and 83*b* are in contact with the outer peripheral wall portions 41*a* and 46*b*, the second flat surfaces 83*a* and 83*b* are not in strong contact with the outer peripheral wall portions 41*a* and 46*b*. Therefore, it can be prevented that the pressing operation executed by the pressing portions 86*a* and 86*b* that are arranged to be closer to the distal ends of the guide ring 80 than the second flat surfaces 83*a* and 83*b* are, is disturbed due to a contact between the second flat surfaces 83*a*, 83*b* and the outer peripheral wall portions 41*a*, 46*b*.

Since the second flat surfaces 83*a* and 83*b* limit the movements of the nozzle body 41 and the orifice plate 46 in a direction along the first flat surface 81, the second flat surfaces 83*a* and 83*b* can execute a minimization function to minimize axis misalignments of the nozzle body 41 and the orifice plate 46. The minimization function is particularly efficient to the second member.

According to the present embodiment, since the second flat surfaces 83*a* and 83*b* is arranged along a direction perpendicular to the first flat surface 81, the nozzle body 41 and the orifice plate 46 can move in the direction to generate a misalignment relative to the guide ring 80. Therefore, even when the distance D3 between the center axis line CL and the nozzle flat surface 42 varies, the outer peripheral wall portion 41*a* is not in strong contact with the guide ring 80 and the nozzle flat surface 42 is in surface contact with the first flat surface 81, in the nozzle body 41. Further, even when the distance D3 between the center axis line CL and the orifice flat surface 47 varies, the outer peripheral wall portion 46*b* is not in strong contact with the guide ring 80 and the orifice flat surface 47 is in surface contact with the first flat surface 81, in the orifice plate 46. Thus, since the second flat surfaces 83*a* and 83*b* are provided, a variation of a position of each flat surface 42, 47 is allowable.

According to the present embodiment, the rigidities of the second extension walls 84*a* and 84*b* in the radial direction are set to be low. Therefore, the guide ring 80 can ensure the pressing forces of the pressing portions 86*a* and 86*b* which is necessary to pinch the outer peripheral wall portions 41*a* and 46*b*, by positively bending the second extension walls 84*a* and 84*b* that are arranged to be closer to the distal ends of the guide ring 80 than the second flat surfaces 83*a* and 83*b*.

According to the present embodiment, since the thin wall portions 85*a* and 85*b* are provided in the second extension walls 84*a* and 84*b*, the rigidities of the second extension walls 84*a* and 84*b* are surely less than the rigidities of the first extension walls 82*a* and 82*b*. Thus, since the pressing forces of the pressing portions 86*a* and 86*b* can be ensured, the guide ring 80 is surely assembled with the first member in a state where a backlash does not exist between the guide ring 80 and the first member. Therefore, the positioning accuracy is further improved.

According to the present embodiment, the nozzle body 41 corresponds to an injection-port forming member, and the orifice plate 46 corresponds to a passage forming member. Further, the nozzle flat surface 42 and the orifice flat surface 47 correspond to a continuous flat surface, and the guide ring 80 corresponds to a positioning member. Furthermore, the first flat surface 81 corresponds to an opposite flat surface, the second flat surfaces 83*a* and 83*b* correspond to a facing flat surface, and the center vertical section CVS corresponds to a virtual vertical section.

Other Embodiment

The present disclosure is not limited to the embodiment mentioned above, and can be applied to various embodiments within the spirit and scope of the present disclosure.

According to the above embodiment, only one nozzle flat surface 42 is arranged on the outer peripheral wall portion 41*a* and only one orifice flat surface 47 is arranged on the outer peripheral wall portion 46*b*. However, the outer peripheral wall portions 41*a* and 46*b* can include plural nozzle flat surfaces and orifice flat surfaces, respectively, and the nozzle flat surfaces and the orifice flat surfaces can be connected with each other. In this case, the first flat surface 81 of the guide ring 80 may include surfaces a total number of which is equal to a total number of the nozzle flat surfaces or a total number of the orifice flat surfaces, or may include only one surface. When the first flat surface 81 only includes one surface, one of two sets of surfaces which are the nozzle flat surfaces and the orifice flat surfaces is in contact with the first flat surface 81. Thus, the positioning accuracy can be ensured.

According to the above embodiment, the guide ring 80 functions to achieve the positioning between the nozzle body 41 and the orifice plate 46, by a pinching performed by the first flat surface 81 and the two pressing portions 86*a* and 86*b*. In this case, the orifice plate 46 is also equivalent to a nozzle holder. Further, shapes, total numbers, and arrangements of the first flat surface and the pressing portions can be properly changed. For example, the guide ring 80 may include two pressing portions having centers which are shifted from the center 81*c* of the first flat surface 81 by 135 degrees in the peripheral direction, respectively, and may further include another pressing portion. Furthermore, the pressing portions may inwardly protrude from an inner peripheral wall surface that is partially cylindrical-shaped without protruding from an inner peripheral wall surface that is a plane surface. Even though the pressing portions are in point contact with the outer peripheral wall portions, the guide ring 80 can function to achieve the positioning between the nozzle body 41 and the orifice plate 46. Moreover, the arrangements of the plural pressing portions may be not plane symmetry relative to the center vertical section CVS.

According to the above embodiment, the second flat surfaces 83*a* and 83*b* can be cancelled from the guide ring 80. In this case, it is preferable that the inner peripheral wall surface of the guide ring 80 is a cylindrical-shaped surface so as to prevent from being in contact with the outer peripheral wall portions.

According to the above embodiment, the rigidities of the second extension walls 84*a* and 84*b* are reduced by the thin wall portions 85*a* and 85*b*. However, the rigidities of the second extension walls 84*a* and 84*b* can be reduced by providing a notch or a through hole. Further, the rigidities of the second extension walls may be in the same level with rigidities of the first extension walls 82*a* and 82*b* such that a pressing function of the pressing portions can be achieved.

According to the above embodiment, in the guide ring 80, the first flat surface 81, the second flat surfaces 83*a* and 83*b*, and the notch area 89, are formed by continuously cutting a metal member that is ring-shaped by using a cutting tool. In this case, since the notch area 89 is provided in the metal member that is ring-shaped, the end portions 87*a* and 87*b* is inwardly bent in an initial state and improve the pressing function of the pressing portions 86*a* and 86*b*. However, a material and a processing of the guide ring 80 can be properly changed. For example, a guide ring that is made of a metal and is formed by sintering may be used. Alternatively, the guide ring may be made of a resin material or a ceramic material.

According to the above embodiment, the positioning between the nozzle body 41 and the orifice plate 46 which is achieved by the guide ring 80 included in the fuel injector 100 can be achieved by a working by using a jig such as a snap gauge. Specifically, the snap gauge that is a thick plate shape includes a notch that is a U shape. A gauge flat surface that is equivalent to the first flat surface is arranged at an end of the notch. A worker presses the nozzle flat surface and the orifice flat surface to the gauge flat surface so as to be in contact with the gauge flat surface, by externally fitting the snap gauge to the outer peripheral wall portions of the nozzle body and the orifice plate. As a result, the nozzle body is positioned in the correct position relative to the orifice plate in the peripheral direction. As the above description, even the snap gauge is used to position the nozzle body 41 and the orifice plate 46, the positioning accuracy can be easily ensured.

According to the above embodiment, the nozzle body 41 is positioned relative to the orifice plate 46. However, the positioning of the nozzle body may be properly changed to be relative to another member, according to a configuration of the fuel injector. According to the present disclosure, the positioning of the nozzle body can be executed relative to any parts that are adjacent to the nozzle body.

As the above description, the above embodiment where the present disclosure is applied to the fuel injector used in the diesel engine is described. However, the present disclosure may be applied to a fuel injector used in an internal combustion engine including an auto cycle engine, without limiting to the diesel engine. Further, the fuel injected by the fuel injector is not limited to a light oil, and a dimethyl ether, liquefied petroleum gas, or a gasoline may be used as the fuel.

While the present disclosure has been described with reference to the embodiments thereof, it is to be understood that the disclosure is not limited to the embodiments and constructions. The present disclosure is intended to cover various modification and equivalent arrangements. In addition, while the various combinations and configurations, which are preferred, other combinations and configurations, including more, less or only a single element, are also within the spirit and scope of the present disclosure.

What is claimed is:

1. A fuel injector comprising:

an injection-port forming member defining an injection port that injects a fuel towards a combustion chamber of an internal combustion engine;

a passage forming member being in contact with the injection-port forming member and defining a supply passage that supplies the fuel to the injection port; and a positioning member being a partially ring shape, the positioning member spanning and being externally fitted to the injection-port forming member and the passage forming member, the positioning member executing a positioning between the injection-port forming member and the passage forming member, wherein the injection-port forming member and the passage forming member include continuous flat surfaces that can be connected with each other, respectively, the continuous flat surfaces being arranged at outer peripheral wall portions to which the positioning member is externally fitted, the positioning member includes an opposite flat surface that faces both the continuous flat surfaces in a case where the positioning member is externally fitted to the injection-port forming member and the passage forming member, and a pressing portion that inwardly press the outer peripheral wall portions such that the continuous flat surfaces are in contact with the opposite flat surface, and the opposite flat surface intersects a radius passing through a center of the positioning member in a radial direction of the positioning member at a right angle.

2. The fuel injector according to claim 1, wherein only one continuous flat surface being in contact with the opposite flat surface is arranged on the outer peripheral wall portion of the injection-port forming member, and only one continuous flat surface being in contact with the opposite flat surface is arranged on the outer peripheral wall portion of the passage forming member.

3. The fuel injector according to claim 1, wherein the positioning member includes at least two pressing portions, the two pressing portions are arranged in areas interposing the opposite flat surface in a peripheral direction of the positioning member, and the two pressing portions are placed at positions closer to end portions than the opposite flat surface is, respectively, in the positioning member that is a partially ring shape.

4. The fuel injector according to claim 3, wherein each of the pressing portions has a center which is shifted from a center of the opposite flat surface by an angle that is larger than 90 degrees in the peripheral direction of the positioning member.

5. The fuel injector according to claim 3, wherein the two pressing portions are placed at positions to be plane symmetry relative to a center vertical section that is a virtual plane surface including a center axis line of the positioning member and is perpendicular to the opposite flat surface.

6. The fuel injector according to claim 3, wherein the positioning member includes a pair of facing flat surfaces which are placed at positions that are shifted from the center of the opposite flat surface by 90 degrees in the peripheral direction and face to each other by interposing a center axis line of the positioning member.

7. A fuel injector comprising:

an injection-port forming member defining an injection port that injects a fuel towards a combustion chamber of an internal combustion engine;

a passage forming member being in contact with the injection-port forming member and defining a supply passage that supplies the fuel to the injection port; and a positioning member being a partially ring shape, the positioning member spanning and being externally fitted to the injection-port forming member and the passage forming member, the positioning member executing a positioning between the injection-port forming member and the passage forming member, wherein the injection-port forming member and the passage forming member include continuous flat surfaces that can be connected with each other, respectively, the continuous flat surfaces being arranged at outer peripheral wall portions to which the positioning member is externally fitted, the positioning member includes an opposite flat surface that faces both the continuous flat surfaces in a case where the positioning member is externally fitted to the injection-port forming member and the passage forming member, and a pressing portion that inwardly press the outer peripheral wall portions such that the continuous flat surfaces are in contact with the opposite flat surface, the positioning member includes at least two pressing portions, the two pressing portions are arranged in areas interposing the opposite flat surface in a peripheral direction of the positioning member, and the two pressing portions are placed at positions closer to end portions than the opposite flat surface is, respectively, in the positioning member that is a partially ring shape, the positioning member includes a pair of facing flat surfaces which are placed at positions that are shifted from the center of the opposite flat surface by 90 degrees in the peripheral direction and face to each other by interposing a center axis line of the positioning member, each of the outer peripheral wall portions includes an area excluding the continuous flat surface is a partially cylindrical-shaped surface, and the pair of the facing flat surfaces has a separating dimension that is a distance between the facing flat surfaces, and the separating dimension is set to be substantially as the same as a maximum outer diameter dimension of each of the outer peripheral wall portions.

8. A fuel injector comprising:

an injection-port forming member defining an injection port that injects a fuel towards a combustion chamber of an internal combustion engine;

a passage forming member being in contact with the injection-port forming member and defining a supply passage that supplies the fuel to the injection port; and a positioning member being a partially ring shape, the positioning member spanning and being externally fitted to the injection-port forming member and the passage forming member, the positioning member executing a positioning between the injection-port forming member and the passage forming member, wherein the injection-port forming member and the passage forming member include continuous flat surfaces that can be connected with each other, respectively, the continuous flat surfaces being arranged at outer peripheral wall portions to which the positioning member is externally fitted, the positioning member includes an opposite flat surface that faces both the continuous flat surfaces in a case where the positioning member is externally fitted to the injection-port forming member and the passage forming member, and a pressing portion that inwardly press the outer peripheral wall portions such that the continuous flat surfaces are in contact with the opposite flat surface, the positioning member includes at least two pressing portions, the two pressing portions are arranged in areas interposing the opposite flat surface in a peripheral direction of the positioning member, and the two pressing portions are placed at positions closer to end portions than the opposite flat surface is, respectively, in the positioning member that is a partially ring shape, the positioning member includes a pair of facing flat surfaces which are placed at positions that are shifted from the center of the opposite flat surface by 90 degrees in the peripheral direction and face to each other by interposing a center axis line of the positioning member, the positioning member includes a first extension wall that extends from the opposite flat surface to the facing flat surface, and a second extension wall that extends from the facing flat surface to the pressing portion, and the second extension wall has a rigidity less than a rigidity of the first extension wall.

9. The fuel injector according to claim 8, wherein the second extension wall includes a thin wall portion having a thickness that is thinner than a thicknesses of the first extension wall.

* * * * *